US008201512B2

(12) United States Patent
Elbert

(10) Patent No.: US 8,201,512 B2
(45) Date of Patent: Jun. 19, 2012

(54) WATERCRAFT STEERING SYSTEM

(76) Inventor: Gregory J. Elbert, Frederick, MD (US)

( * ) Notice: Subject to any disclaimer, the term of this patent is extended or adjusted under 35 U.S.C. 154(b) by 137 days.

(21) Appl. No.: 12/834,005

(22) Filed: Jul. 11, 2010

(65) Prior Publication Data

US 2012/0006248 A1 Jan. 12, 2012

(51) Int. Cl.
*B63B 1/28* (2006.01)

(52) U.S. Cl. ..... 114/280; 114/281

(58) Field of Classification Search ..... 114/274, 114/280, 281
See application file for complete search history.

(56) References Cited

U.S. PATENT DOCUMENTS

| | | | | |
|---|---|---|---|---|
| 1,676,158 | A | 7/1928 | Roe | |
| 2,840,832 | A | 7/1958 | Fried | |
| 2,887,082 | A * | 5/1959 | Boericke, Jr. et al. | 114/281 |
| 2,972,974 | A | 2/1961 | Follett | |
| 3,094,961 | A | 6/1963 | Smith | |
| 3,112,725 | A | 12/1963 | Malrose | |
| 3,143,996 | A | 8/1964 | Chapman | |
| 3,267,897 | A | 8/1966 | Picker | |
| 3,646,905 | A | 3/1972 | Martinmaas | |
| 3,669,053 | A | 6/1972 | Sorenson | |
| 3,762,353 | A | 10/1973 | Shutt | |
| 3,922,994 | A | 12/1975 | De Long | |
| 3,926,138 | A | 12/1975 | Eichler | |
| 4,061,104 | A * | 12/1977 | Pinchot, III | 114/281 |
| 4,114,912 | A | 9/1978 | Sweeney | |
| 4,135,470 | A | 1/1979 | Ono | |
| 4,711,195 | A | 12/1987 | Shutt | |
| 5,285,742 | A | 2/1994 | Anderson | |
| 5,329,870 | A | 7/1994 | Cook | |
| 5,390,623 | A | 2/1995 | Mackaness | |
| 5,638,766 | A * | 6/1997 | Pusterla | 114/274 |
| 5,697,317 | A | 12/1997 | Pereira | |
| 6,095,076 | A | 8/2000 | Nesbitt | |
| 6,497,189 | B1 * | 12/2002 | Vollmerhausen | 114/67 A |
| 7,913,635 | B2 * | 3/2011 | Pusterla | 114/274 |

* cited by examiner

*Primary Examiner* — Stephen Avila
(74) *Attorney, Agent, or Firm* — Lawrence J. Shurupoff

(57) ABSTRACT

A steering system for hydroski-borne watercraft eliminates the need for conventional steering mechanisms such as rudders or thrust vectoring from propulsion units. Complete steering and navigable control is achieved by rolling or otherwise banking individual hydroskis thereby creating a side force on each hydroski. This force is proportional to the sine of the bank angle or roll angle. The sum of the forces and moments from the individual hydroskis are of sufficient magnitude and can be appropriately balanced to effect coordinated watercraft steering and navigable control.

21 Claims, 8 Drawing Sheets

FIG. 12

WATERCRAFT STEERING SYSTEM

BACKGROUND

In static, idling or at rest conditions, hydroski-borne watercraft require sufficient volume from a displacement hull to keep the watercraft afloat. In high speed conditions, hydroski-borne watercraft must generate enough hydrodynamic lift from a plurality of hydroskis to lift the displacement hull out of the water. At speeds greater than their planing speed, hydro ski-borne watercraft require no buoyant lift from the displacement hull. This results in a significant advantage.

That is, hydroski-borne watercraft achieve extreme efficiency at speeds where the hydroskis generate enough hydrodynamic force to lift the displacement hull out of the water, thereby eliminating the hydrodynamic drag on the displacement hull. Hydroski-borne watercraft experience a significant drag reduction when the displacement hull elevates above the water as the hydroskis go on plane, thereby reducing required thrust and power, which in turn leads to decreased fuel consumption and improved fuel economy.

SUMMARY

In accordance with this disclosure, directional control of hydroski-borne watercraft can be achieved without conventional thrust vectoring and/or rudders. This control can be achieved by adjusting the roll angle of individual hydroskis about their individual longitudinal axes regardless of the size, weight and number of hydroskis employed in a watercraft design. The hydroski-borne watercraft steering concept described herein applies to hydroski-borne watercraft with hydroskis numbering as few as three and up to virtually an unlimited maximum.

The hydroski-borne watercraft steering system, which can operate without thrust vectoring and/or rudders, can made use of simpler fixed thrust mechanisms such as fixed water propellers, fixed water jet drives, fixed air propellers, fixed turbo jets and fixed turbo-fans. The absence of conventional water-based (submerged) steering mechanisms at high speeds further reduces hydrodynamic friction and drag, thereby reducing required thrust and power which in turn leads to decreased fuel consumption and improved fuel economy. Moreover, the absence of submerged steering mechanisms and submerged thrusting mechanisms, in conjunction with hydroskis having shallow entry angles with the waterline (angles of attack) and shallow operational drafts enables a hydroski-borne watercraft to be largely unaffected by floating debris in the water.

In accordance with this disclosure, navigational control and watercraft steering is produced by side forces acting on individual hydroskis. These side forces are generated by actuating or driving an angular displacement or roll on a hydroski such as about an individual hydroski's local longitudinal axis. Electric motors driving articulated linkages can be provided to roll one or more skis in a mutually coordinated manner. Other drivers such as hydraulic and/or pneumatic motors and/or cylinders can also be effectively employed to provide a pivoting, banking or rolling motion to one or more hydroskis, such as about an axis substantially parallel to the longitudinal axis of a hydroski.

The side force on an individual hydroski is proportional to the sine of the roll angle of the hydroski with respect to the surface of the water and the lift force is proportional to the cosine of the roll angle of the hydroski with respect to the surface of the water. The sum of the individual hydroski forces and moments directly affects a hydroski-borne watercraft's steering and navigable control.

The term "roll", "rolling", or "rollable" as used herein is intended to mean any motion where a hydroski moves in a pivoting, rolling, rotating, tilting or banking motion so that one lateral side portion or edge portion of the hydroski moves downwardly or deeper into a body of water and the opposite lateral side portion or edge portion of the hydroski moves upwardly or shallower with respect o to the body of water. The result is a lateral banking movement of a hydroski somewhat similar to the attitude and movement of a snow ski in a banked turn.

This rolling or banking movement can be centered about an axis which extends longitudinally through the body of the hydroski or through an axis located adjacent to or spaced apart from the body of the hydroski. In the latter case, the roll axis need not be exactly parallel with the longitudinal axis of the hydroski but may be somewhat skewed to such axis. A roll or rolling movement can be achieved with or without a pure rotational movement about an axis. For example, a hydroski can be "rolled" along a non-circular cam surface or driven through a noncircular path or curve with a mechanical linkage. What is required is that a resultant side force is generated against the front or bottom surface of a hydroski to provide a turning force and/or turning moment to effect navigable control of a watercraft.

Through coordinated control of the lateral roll angles of one or a plurality of individual hydroskis on a hydroski-borne watercraft, the resulting net forces and moments are capable of controlling the watercraft's steering and navigable control. The combined effect of the coordinated rolling of a plurality of hydroskis and optional inclusion of shock absorption on the individual hydroskis provides a smooth ride, even in high seas.

When operating at higher planing speeds, a hydroski-borne watercraft can optionally retract one or more of its hydroskis above the waterline and realize even greater efficiency by reducing the total aggregate contact area between the hydroskis and the water surface. There are many possible combinations of individual hydroski banking movements and/or roll angles that will produce net forces and moments that are capable of controlling the hydroski-borne watercraft's steering and navigable control.

A watercraft constructed in accordance with this disclosure is designed to minimize hydrodynamic drag by riding atop water skis or hydroskis. A plurality of hydroskis is attached or coupled to a watercraft, for example, using struts extending below a buoyant hull. When resting in the water at idle speed, the hull floats and the hydroskis and the struts can rest below the surface of the water.

As speed increases, the hull lifts out of the water in a hydrodynamic fashion with minimal to no reliance on aerodynamic lift and the hyrdoskis are able to support the watercraft above the waterline. When riding on hydroskis with the hull elevated above the waterline, the hydrodynamic drag on the watercraft is significantly reduced, resulting in a substantial increase in speed, efficiency and maneuverability.

The steering and ride produced by the hydroskis can be controlled by a passive or fixed strut system, e.g. strut-mounted shock absorbers or by an active strut system, e.g. positively actuated struts moved by one or more electric, electronic, hydraulic or pneumatic actuators. Such actuators or mechanisms also have the ability to roll the watercraft about its longitudinal axis as a means of turn coordination, as discussed further below.

A watercraft constructed in accordance with this disclosure can be propelled by one or a combination of several mechanisms of propulsion including an outboard motor with a submerged propeller, an inboard motor with a submerged propeller, a thrust-producing fan or turbine, and/or a water jet/impeller system. A fan, jet or turbine can be located completely above the waterline to minimize hydrodynamic drag while providing motive thrust to a watercraft.

A number of watercraft steering mechanisms are available for directional control. At low speeds when the hull is in the water, conventional steering devices such as a rudder or directed water thrust can be employed. At higher speeds, when a hydrocraft is supported exclusively by hydroskis, the steering control problem is much more difficult.

To achieve directional control at higher planing speeds, an actuator or driver can rotate, roll or otherwise move or turn, for example, a front hydro ski about a local longitudinal axis or motion path or roll the hydroski about a local lateral axis, thereby banking the hydroski and diverting water opposite to the direction of the turn, and thereby force the watercraft to change direction in a skidding fashion. Optionally, to compensate for the effects of skidding, the struts of hydroskis not banked or rolled can instead be raised or lowered above and below the waterline so that the hull of the watercraft rotates about its longitudinal axis, thereby banking during the turn in a coordinated fashion.

Likewise, in a system with multiple front hydroskis, each front hydroski can be rotated about a local longitudinal axis and/or a local lateral axis or otherwise moved, banked or tilted sideways (port or starboard) as described above. Turn coordination can also be achieved as described above. Further details of various hydroski steering systems are described below.

BRIEF DESCRIPTION OF THE DRAWINGS

In the drawings.

In the various view of the drawings, like reference numerals designate like or similar parts.

Detailed Description of Representative Embodiments

Figure 1:
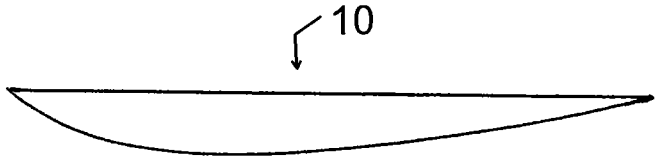
FIG. 1 is a side elevation view of a representative hydroski oriented in a retracted or non-operating horizontal position.

As schematically seen in FIG. 1, a hydroski 10 is oriented in a non-operating generally horizontal position. This position represents an example of a hydroski 10 in a stored or inoperative at rest position such as at a location above the waterline of a watercraft. In one embodiment, the hydroski 10 can be vertically movably coupled to the hull of a watercraft such that hydroski 10 can be raised above the waterline to a storage position such as shown in FIG. 1 and selectively lowered to an operative position within the water such as shown in FIG. 2.

Figure 2:
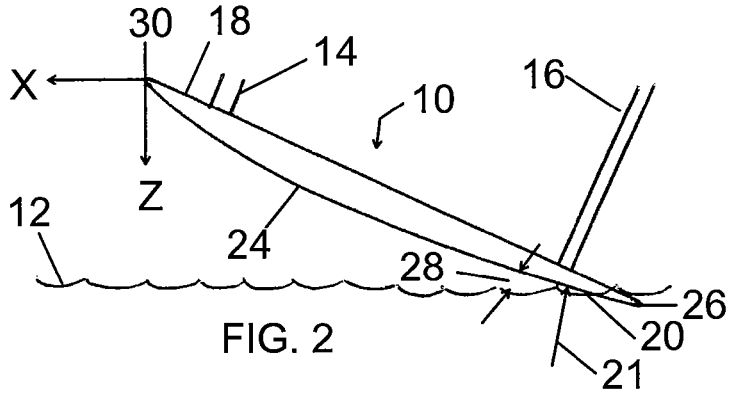
FIG. 2 is a side elevation view of the hydroski of FIG. 1 oriented in a deployed operating position.

When initially positioned in an operative position, the hydroski 10 may be completely submerged or partially submerged below the waterline 12 as shown in FIG. 2. The hydroski 10 can be coupled to the hull of a watercraft with struts 14, 16 as described more fully below. When in a planing position as shown in FIG. 2, the forward or bow portion 18 of hydroski 10 is elevated above the waterline 12 and the rear, stern or aft portion 20 of the hydroski 10 is submerged below the waterline 12.

While various motors and/or actuators can be employed to raise and lower the hydroski 10 above and below the waterline 12, it is also effective to simply fit the hydroski in a permanent or semi-permanent fixed position such as in the operative position shown in FIG. 2. This can be achieved by fixing the struts 14, 16 to the hull of a watercraft to maintain a fixed angle of attack between the lower surface or front face 24 of hydroski 10 and waterline 12, such as within an operative range of about 5° to about 15°, plus or minus a few degrees. It is also possible to permanently locate the hydroski 10 in a deployed position, yet provide for a forward and aft tilting of the hydroski to selectively vary the angle of attack in addition to the side-to-side or port-to-starboard and starboard-to-port rolling or banking movement discussed below.

In each case noted above, the hydroski 10 is adapted to rock, roll, tilt or bank such as about a roll axis extending longitudinally through the hydroski 10 or substantially parallel to a longitudinal axis extending through the hydroski 10, but spaced apart therefrom, as described more fully below.

As noted above, FIG. 2 is a side view of a notional hydroski 10 deployed in an operative position. A local right-handed coordinate system is attached to the hydroski's leading edge 30 with the x axis pointing forward, the y axis pointing into the page, and the z axis pointing downward coincident with gravity. At high speeds, hydrodynamic forces are generated on the front face 24 of the hydroski 10. The hydrodynamic force vector 21 acts normal to the front facing surface 24 of the hydroski 10. Vector 21 can be separated into vertical and horizontal force components which are the hydrodynamic lift and drag forces, respectively. When the vertical lift force exceeds the weight on the hydroski 10, it elevates out of the water.

The operational waterline 12 shows that only the rear portion 20 of the hydroski 10 is in contact with the water. The hydrodynamic lift and drag forces are concentrated near or adjacent to the trailing edge 26. Draft requirements are minimal as only a small portion of hydroski 10 extends below the waterline 12 when the hydroski 10 is on plane as seen in FIG. 2. The operational waterline 12 and the shape of the hydroski 10 show that the entry angle 28 of the deployed hydroski 10 into the water is shallow, for example, 5° to 15°, which mitigates the effects of impact with floating debris. Substantially vertical compression struts 14, 16 connect the hydroski 10 to the hull of a watercraft, thereby transferring forces to the hull. The compression struts may be replaced with shock absorbing mechanisms to improve the ride.

It should be noted that the hydroskis 10 need not be buoyant and may be constructed as solid or laminated heavier-than-water fabrications. This is to be contrasted with hollow or lighter-than-water pontoons which provide buoyancy and concomitant hydrodynamic drag at all times. Aluminum, steel, titanium, carbon composite and other construction materials may be used to fabricate the hydroskis 10.

Figure 3:
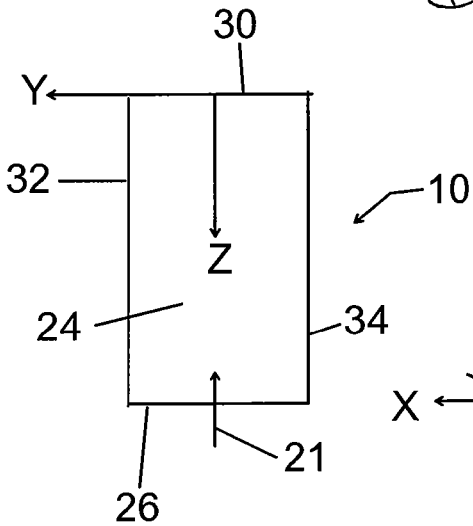
FIG. 3 is a front view of the hydroski of FIG. 2.

FIG. 3 is a front view of a notional hydroski 10 in a deployed position. A local right-handed coordinate system is shown attached to the leading edge 30 of hydroski 10. The x axis points out of the page, the y axis toward the starboard side of the watercraft, and the z axis pointing downward coincident with gravity. Hydroski 10 includes a starboard side edge portion 32 and a port side edge portion 34.

Figure 4:
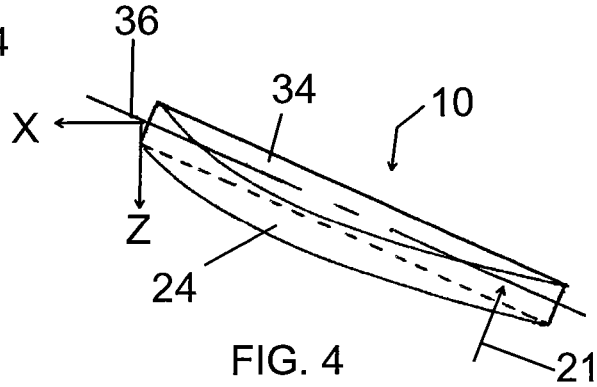
FIG. 4 is a bottom side perspective view of the hydroski of FIG. 2 rolled positively about a local roll axis.

FIG. 4 is a side view of a hydroski 10 rolled positively about a local roll axis 36. The hydrodynamic force vector 21 acts normal to the exposed front face 24 of the hydroski 10, which in this case has a positive force component along the y axis. The side force is proportional to the sine of the roll angle and the lift force decreases with the cosine of the roll angle. This rolling, banking and/or lateral titling movement causes the starboard side edge portion 32 to move downwardly or deeper below the waterline 12 and at the same time causes the port side edge portion 34 to move upwardly or shallower in a body of water than the starboard side edge portion 32. In a typical maneuver, only the front face 24 adjacent the rear portion 20 of the hydroski 10 is acted upon by force vector 21. In this case, hydrodynamic forces on the side edge portions 32, 34 are negligible. This is desirable for positive steering control, without undue influence few from the side edge portions 32, 34.

Figure 5:
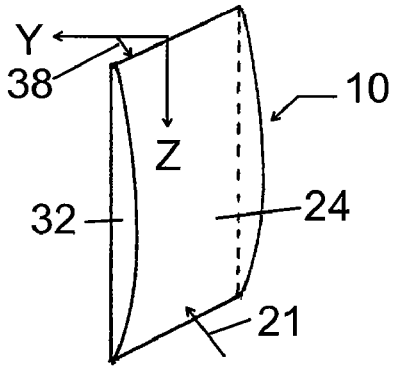
FIG. 5 is a front perspective view of a hydroski rolled positively about a local roll axis.

FIG. 5 is a front view of a hydroski rolled positively about the local roll axis through a roll, tilt or bank angle 38. Roll angle 38 is the angle between a horizontal plane and the front face 24 of hydroski 10, as taken from one lateral side edge portion (32, 34) to the opposite lateral side edge portion normal to the longitudinal axis of the hydroski. The hydrodynamic force vector 21 acts normal to the exposed front face 24 of the hydroski 10, which in this case has a positive force component along the y axis.

Figure 6:
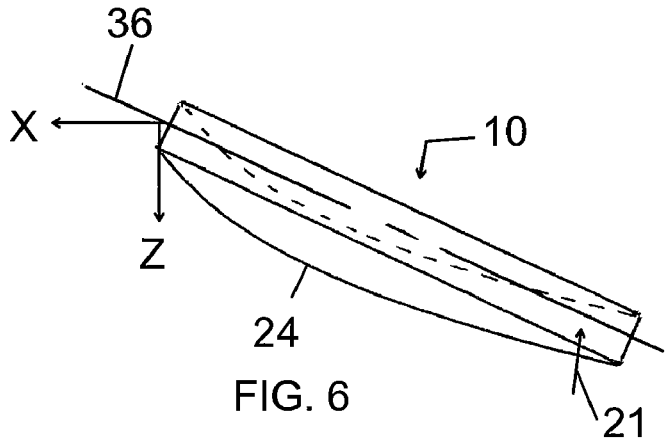
FIG. 6 is a top side perspective view of a hydroski rolled negatively about a local roll axis.

FIG. 6 is a side view of a hydroski 10 rolled negatively about a local roll axis 36. The hydrodynamic force vector 21 acts normal to the exposed front face 24 of the hydroski 10, which in this case has a negative force component along the y axis. Again, the side force is proportional to the sine of the roll angle and the lift force decreases with the cosine of the roll angle.

Figure 7:
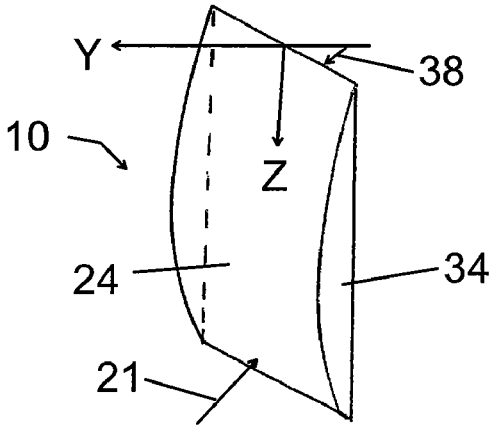
FIG. 7 is a front perspective view of a hydroski rolled negatively about a local roll axis.

FIG. 7 is a front view of a hydroski 10 rolled negatively about a local roll axis through roll angle 38. The hydrodynamic force vector 21 acts normal to the exposed front face 24 of the hydroski 10, which in this case has a negative force component along the y axis.

Figure 8:
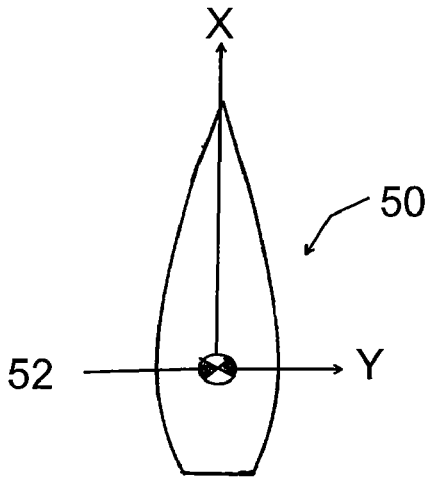
FIG. 8 is a schematic top plan view of a watercraft constructed in accordance with the disclosure.

FIG. 8 is a top plan view of a watercraft 50 with a coordinate system origin located at the watercraft's center of gravity 52. The x axis points forward, the y axis points to the starboard side, and the z axis points down into the water, coincident with gravitational force.

Figure 9:
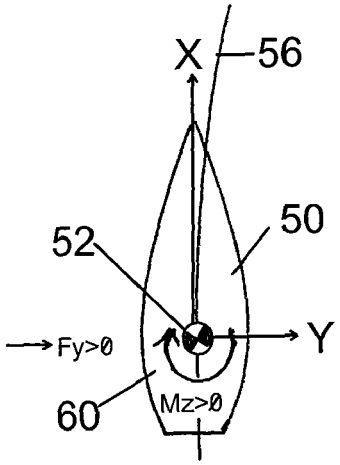
FIG. 9 is a view of FIG. 8 showing a representative path of movement for a starboard turn.

FIG. 9 is a top plan view of a watercraft 50 directed along a notional navigation track 56 that would be followed during a starboard turning maneuver. The coordinate system origin is located at the watercraft's center of gravity 52. A starboard turning maneuver is a positive steering maneuver which requires a positive force $F_y$ along the y axis and a positive moment M, about the z axis. The positive force $F_y$ along the y axis accelerates the watercraft 50 in the starboard direction, and the positive moment $M_z$, about the z axis yaws the watercraft 50 in a clockwise sense 60 as viewed from above.

Figure 10:
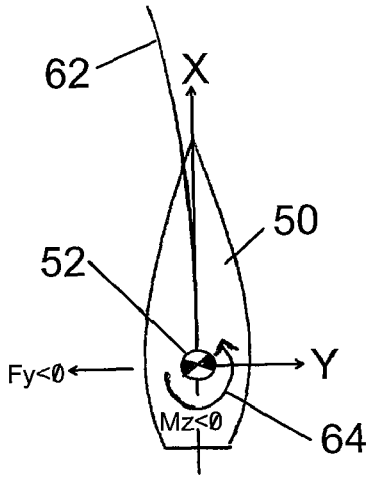
FIG. 10 is a view similar to FIG. 9 showing a representative path of movement for a port turn.

FIG. 10 is a top plan view of a watercraft 50 directed along a notional navigation track 62 that would be followed during a port turning maneuver. The coordinate system origin is located at the watercraft's center of gravity 52. A port turning maneuver is a negative steering maneuver which requires a negative force $F_y$ along the y axis and a negative moment $M_z$ about the z axis. The negative force $F_y$ along the y axis accelerates the watercraft 50 in the port direction, and the negative moment $M_z$ about the z axis yaws the watercraft 50 in a counter-clockwise sense 64 as viewed from above.

Figure 11:
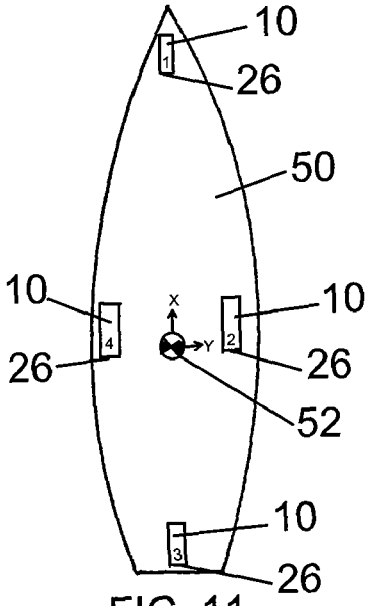
FIG. 11 is a schematic top plan view of a hydroski-borne watercraft employing four hydroskis.

FIG. 11 is a top plan view of a notional hydroski-borne watercraft 50 employing four hydroskis 10 identified individually with numbers 1, 2, 3 and 4. The watercraft's center of gravity 52 is located at the geometric centroid of trailing edges 26 of the four hydroskis 10, which evenly distributes the watercraft's total weight among the four hydroskis 10. The hydroskis are numbered from 1 to 4 starting at the forwardmost hydroski 10 and progressing in a clockwise direction.

While FIG. 11 depicts four hydroskis 10, it is also possible to effectively control the watercraft 50 with only three hydroskis 10. In this case, the front hydroskis 1 or the rear hydroski 10 can be eliminated to provide a simple, low-cost steering and navigational control system for watercraft 50.

Figure 12:
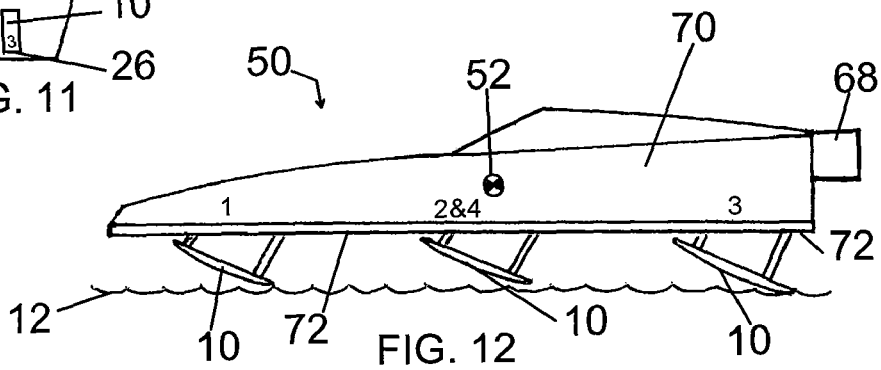
FIG. 12 is a port side view of FIG. 11.

FIG. 12 is a port side view of a notional hydroski-borne watercraft 50 employing the four hydroskis 10 as shown in FIG. 11. The watercraft 50 is depicted with a notional superstructure 70 and hull 72. A source of thrust 68 is located completely above the waterline 12 to minimize drag. Thrust source 68 can be a fan, turbofan, jet engine or any other suitable form of thrust.

TABLE 1

| | Positive (starboard) turn | | | | Negative (port) turn | | | |
|---|---|---|---|---|---|---|---|---|
| Option | Ski 1 | Ski 2 | Ski 3 | Ski 4 | Ski 1 | Ski 2 | Ski 3 | Ski 4 |
| A | $+\Theta_1$ | 0 | 0 | 0 | $-\Theta_1$ | 0 | 0 | 0 |
| B | $+\Theta_1$ | $+\Theta_2$ | 0 | 0 | $-\Theta_1$ | 0 | 0 | $-\Theta_4$ |
| C | $+\Theta_1$ | $+\Theta_2$ | 0 | $+\Theta_4$ | $-\Theta_1$ | $-\Theta_2$ | 0 | $-\Theta_4$ |
| D | $+\Theta_1$ | 0 | 0 | $+\Theta_4$ | $-\Theta_1$ | $-\Theta_2$ | 0 | 0 |
| E | $+\Theta_1$ | $+\Theta_2$ | $-\Theta_3$ | 0 | $-\Theta_1$ | 0 | $+\Theta_3$ | $-\Theta_4$ |
| F | $+\Theta_1$ | $+\Theta_2$ | $-\Theta_3$ | $+\Theta_4$ | $-\Theta_1$ | $-\Theta_2$ | $+\Theta_3$ | $-\Theta_4$ |
| G | $+\Theta_1$ | 0 | $-\Theta_3$ | $+\Theta_4$ | $-\Theta_1$ | $-\Theta_2$ | $+\Theta_3$ | 0 |

TABLE 1-continued

| | Positive (starboard) turn | | | | Negative (port) turn | | | |
|---|---|---|---|---|---|---|---|---|
| Option | Ski 1 | Ski 2 | Ski 3 | Ski 4 | Ski 1 | Ski 2 | Ski 3 | Ski 4 |
| H | 0 | $+\Theta_2$ | $-\Theta_3$ | 0 | 0 | 0 | $+\Theta_3$ | $-\Theta_4$ |
| I | 0 | $+\Theta_2$ | $-\Theta_3$ | $+\Theta_4$ | 0 | $-\Theta_2$ | $+\Theta_3$ | $-\Theta_4$ |
| J | 0 | 0 | $-\Theta_3$ | $+\Theta_4$ | 0 | $-\Theta_2$ | $+\Theta_3$ | 0 |

Table 1 identifies 10 possible combinations (A-J) of ski roll angles "Θ" all of which are capable of providing steering and navigable control for the four-hydroski design of FIGS. 11 and 12. In this embodiment, the side forces from hydroskis 2 and 4 have negligible contributions to the yawing moment of watercraft 50 since their hydrodynamic force vectors are nominally located at the center of gravity 52. The roll angles for skis 1 through 4 are respectively defined by $\Theta_1$, $\Theta_2$, $\Theta_3$ and $\Theta_4$.

Option A is the simplest steering solution because only the front hydroski 1 needs to be actuated, and it produces the correct signs for both side force and yawing moment. Option F is the most complex since all four hydroskis 1, 2, 3 and 4 are being actuated, but it is capable of generating the largest forces and moments for highly dynamic steering. Options B, C and D create the yawing moment using only the front hydroski 1. Options E, F and G create the yawing moment using both the front and rear skis. Options H, I and J create the yawing moment using only the rear hydroski 3.

Options C, F, and I roll both hydroskis 2 and 4 to generate side forces. Options B, E and H roll hydroski 2 for a starboard turn and hydroski 4 for a port turn, which means the inside hydroski pulls the watercraft 50 toward the center of the turn. Options D, G and J roll hydroski 4 for a starboard turn and hydroski 2 for a port turn, which means the outside ski pushes the craft toward the center of the turn.

These 10 options for steering and navigable control of a hydroski-borne watercraft 50 illustrate numerous combinations of roll angles that produce net forces and moments capable of steering and navigable control of the watercraft 50. Control of watercraft 50 can be achieved as set forth in table 1 with only three hydroskis using the options A-D with ski 3 eliminated and options H-J with ski 1 eliminated.

Figure 13:
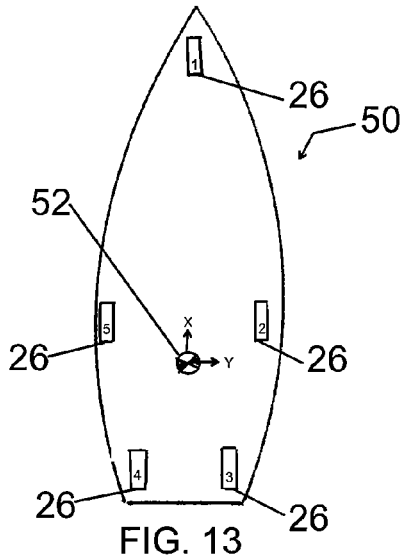
FIG. 13 is a schematic top plan view of a hydroski-borne watercraft employing 5 hydroskis.

FIG. 13 is a plan view of a notional hydroski-borne watercraft 50 employing five hydroskis 10. The watercraft's center of gravity 52 is located at the geometric centroid of trailing edges 26 of the five hydroskis 10, which evenly distributes the watercraft's total weight among the five hydroskis 1-5. The hydroskis are numbered from 1 to 5 starting at the forwardmost hydroski 1 and progressing in a clockwise direction.

Figure 14:
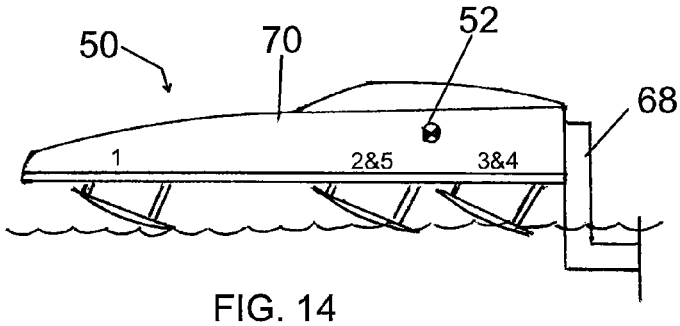
FIG. 14 is a schematic port side view of FIG. 13.

FIG. 14 is a side view of a notional hydroski-borne watercraft 50 employing five hydroskis with a notional superstructure 70. In this example, a source of thrust 68 is shown extending below the waterline 12. Although this produces more drag than a source of thrust located above the waterline 12, conventional sources of thrust can be used, such as water jets, inboard and outboard motors with propeller drives and the like.

Figure 15:
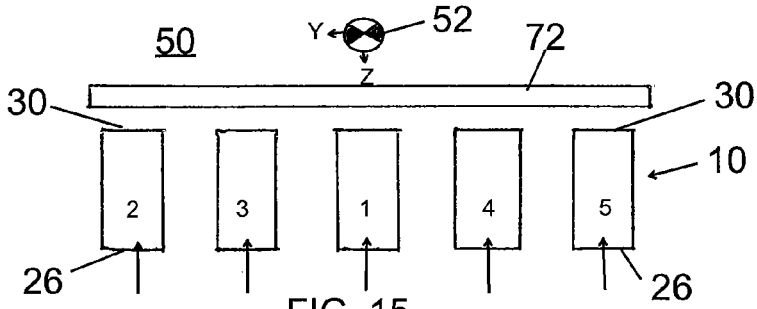
FIG. 15 is a schematic front view of the hydroskis of FIG. 13.

FIG. 15 is a front view of a notional hydroski-borne watercraft 50 employing five hydroskis arranged adjacent hull 72, with the superstructure 70 removed for clarity. None of the hydroskis 10 is rolled about its local roll axis, so there are no side forces being generated and therefore the watercraft 50 travels a straight path.

Figure 16:
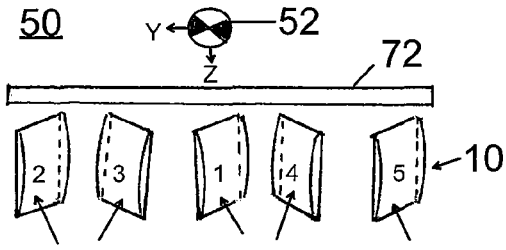
FIG. 16 is a schematic front view of the hydroskis of FIG. 13 arranged to produce a starboard turn.

FIG. 16 is a front view of a notional hydroski-borne watercraft 50 employing five hydroskis 1-5 without a superstructure 70. The individual hydroskis 10 are rolled about their local roll axes in such a manner as to produce a combined positive force along the watercraft's y axis and a combined positive yawing moment about the watercraft's z axis, which will cause the watercraft 50 to make a starboard turn.

Figure 17:
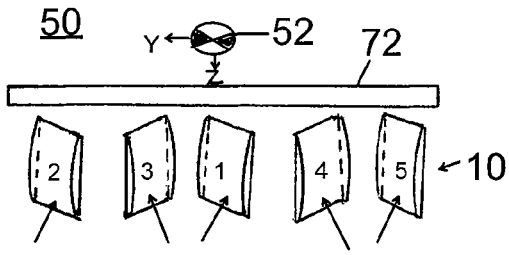
FIG. 17 is a schematic front view of the hydroskis of FIG. 13 arranged to produce a port turn.

FIG. 17 is a front view of a notional hydroski-borne watercraft 50 employing five hydroskis without a superstructure 70. The individual hydroskis are rolled about their local roll axes in such a manner as to produce a combined negative force along the watercraft's y axis and a combined negative yawing moment about the watercraft's z axis, which will cause the watercraft 50 to make a port turn.

Figure 18:
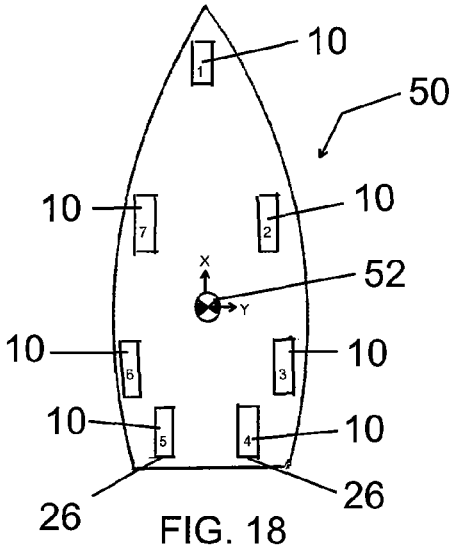
FIG. 18 is a schematic top plan view of a hydroski-borne watercraft employing 7 hydroskis.

FIG. 18 is a plan view of a notional hydroski-borne watercraft 50 employing seven hydroskis 10. The watercraft's center of gravity 52 is located at the geometric centroid of trailing edges 26 of the seven hydroskis, which evenly distributes the watercraft's total weight among the seven hydroskis. The hydroskis 10 are numbered from 1 to 7 in FIG. 18 starting at the forwardmost hydroski 10 and progressing in a clockwise direction.

Figure 19:
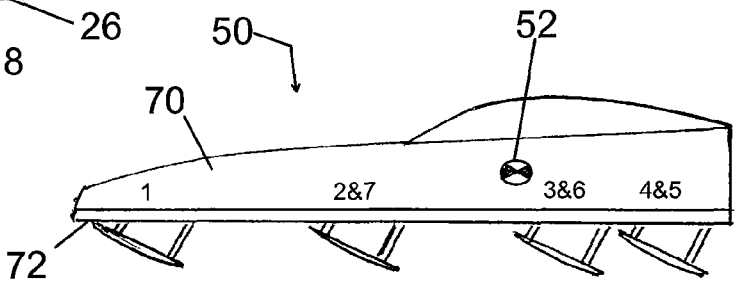
FIG. 19 is a port side view of FIG. 18.

FIG. 19 is a side view of a notional hydroski-borne watercraft 50 employing seven hydroskis with a notional superstructure 70.

Figure 20:
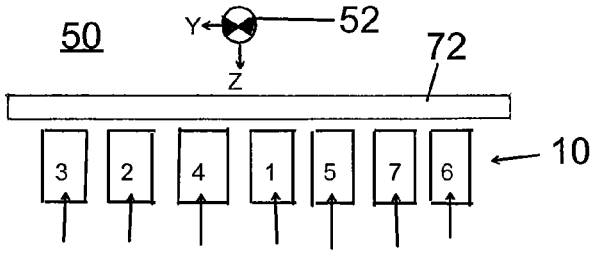
FIG. 20 is a schematic front view of the hydroskis of FIG. 18.

FIG. 20 is a front view of a notional hydroski-borne watercraft 50 employing seven hydroskis without a superstructure. None of the hydroskis are rolled about their local roll axes, so there are no side forces are being generated and the watercraft 50 travels a straight path.

Figure 21:
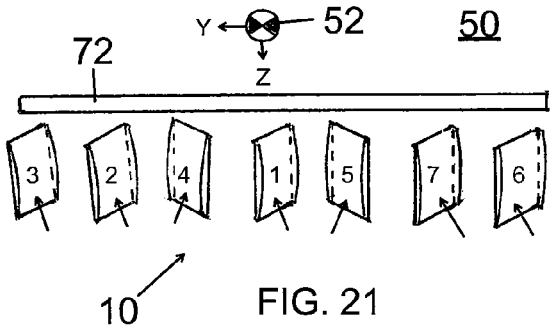
FIG. 21 is a schematic front view of the hydroskis of FIG. 18 arranged to produce a starboard turn.

FIG. 21 is a front view of a notional hydroski-borne watercraft 50 employing seven hydroskis 10 without a superstructure 70. The individual hydroskis are rolled about their local roll axes in such a manner as to produce a combined positive force along the watercraft's y axis and a combined positive yawing moment about the watercraft's z axis, which will cause the watercraft 50 to make a starboard turn.

Figure 22:
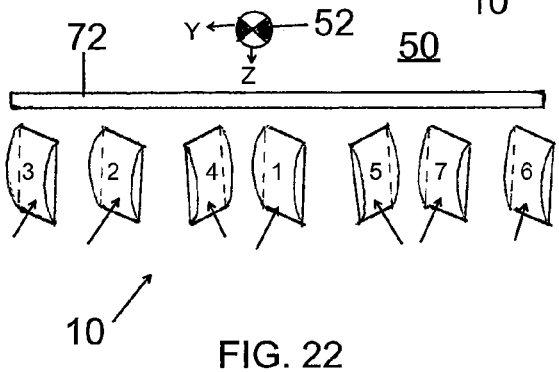
FIG. 22 is a schematic front view of the hydroskis of FIG. 18 arranged to produce a port turn.

FIG. 22 is a front view of a hydroski-borne watercraft 50 employing seven hydroskis 10 without a superstructure 70. The individual hydroskis 1-7 are rolled such as about their local roll axes in such a manner as to produce a combined negative force along the watercraft's y axis and a combined negative yawing moment about the watercraft's z axis, which will cause the watercraft 50 to make a port turn.

Figure 23:
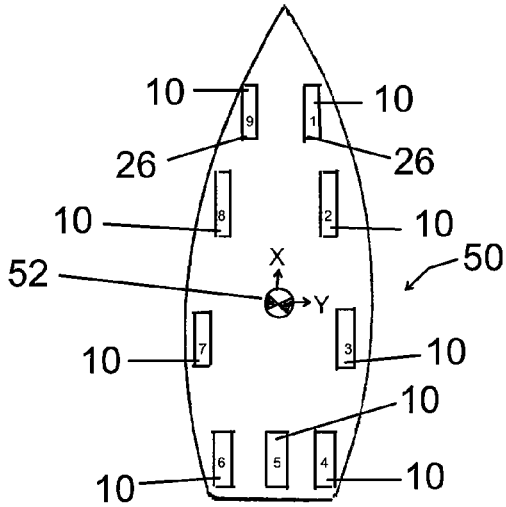
FIG. 23 is a schematic top plan view of a hydroski-borne watercraft employing nine hydroskis.

FIG. 23 is a top plan view of a notional hydroski-borne watercraft 50 employing nine hydroskis 10. The watercraft's center of gravity 52 is located at the geometric centroid of trailing edges 26 of the nine hydroskis, which evenly distributes the watercraft's total weight among the nine hydroskis. The hydroskis are numbered from 1 to 9 starting at the forward, starboard-most hydroski 10.

Figure 24:
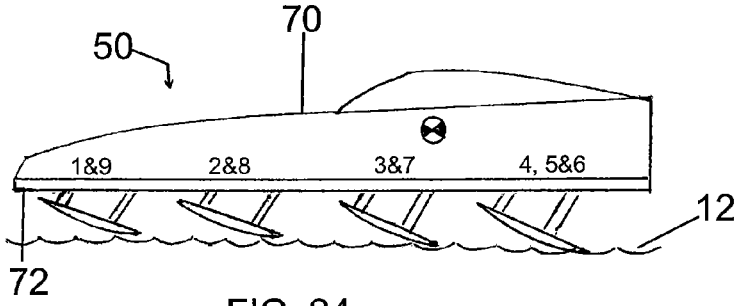
FIG. 24 is a port side view of FIG. 23.

FIG. 24 is a side view of a notional hydroski-borne watercraft 50 employing nine hydroskis with a notional superstructure 70.

Figure 25:
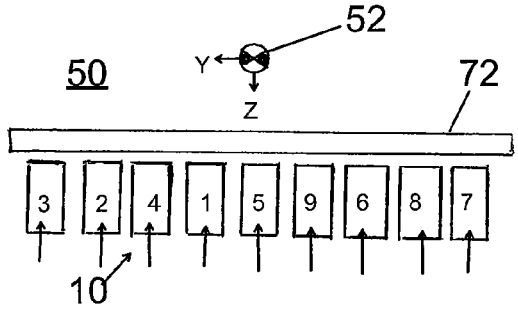
FIG. 25 is a schematic front view of the hydroskis of FIG. 23.

FIG. 25 is a front view of a hydroski-borne watercraft 50 employing nine hydroskis without a superstructure 70. None of the hydroskis 10 is rolled about its local roll axis, so there are no side forces being generated and the watercraft 50 travels a straight path.

Figure 26:
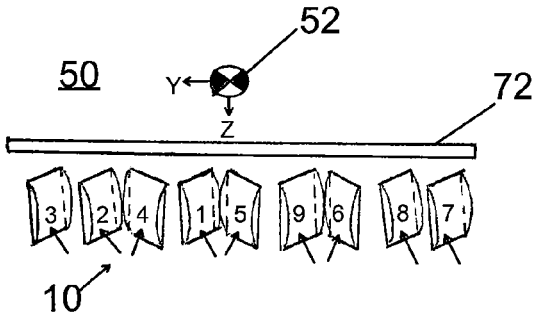
FIG. 26 is a schematic front view of the hydroskis of FIG. 23 arranged to produce a starboard turn.

FIG. 26 is a front view of a hydroski-borne watercraft 50 employing nine hydroskis without a superstructure. The individual hydroskis are rolled such as about their local roll axes in such a manner as to produce a combined positive force along the watercraft's y axis and a combined positive yawing moment about the watercraft's z axis, which will cause the watercraft 50 to make a starboard turn.

Figure 27:
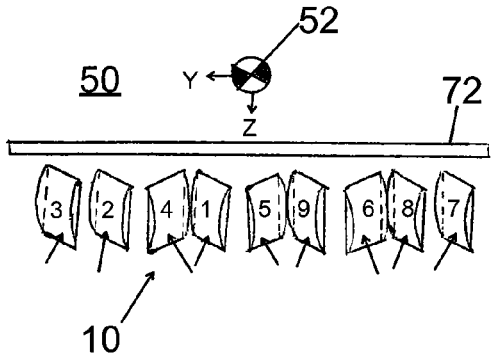
FIG. 27 is a schematic front view of the hydroskis of FIG. 23 arranged to produce a port turn.

FIG. 27 is a front view of a hydroski-borne watercraft 50 employing nine hydroskis 10 without a superstructure. The individual hydroskis 10 are rolled such as about their local roll axes in such a manner as to produce a combined negative force along the watercraft's y axis and a combined negative yawing moment about the watercraft's z axis, which will cause the watercraft 50 to make a port turn.

Additional hydroskis 10 can be employed in virtually any number and effectively coordinated and controlled in accordance with the examples and principles noted above. The larger the watercraft 10, the more hydroskis can be effectively employed.

Figure 28:
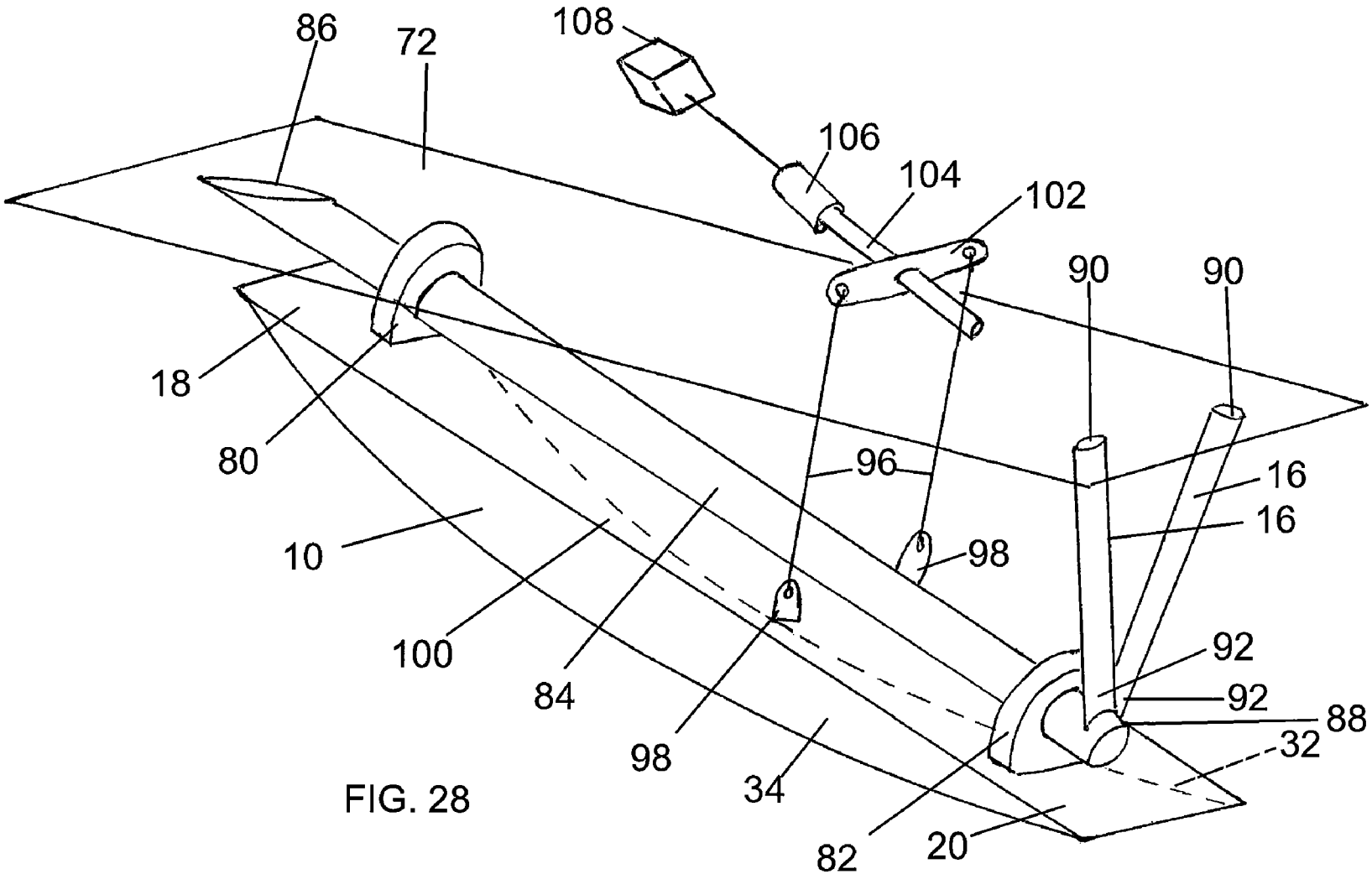
FIG. 28 is a schematic perspective view of one example of a drive mechanism for rolling a hydroski about a local axis.

A representative example of one type of system for rolling a hydroski 10 back and forth from one lateral side portion 32, 34 to the other 32, 34 is shown in FIG. 28. In this example, a front journal bearing 80 is fixed to the front end portion 18 of the hydroski 10 and a rear journal bearing 82 is fixed to the rear end portion 20 of the hydroski 10.

A static shaft 84 is fixed or coupled at its front end portion 86 either directly to the hull 72 or to a beam or other suitable support structure coupled to the hull 72 or coupled to the superstructure 70. The front end portion 80 of the static shaft 84 extends through the front journal bearing 80 and the rear end portion 88 of the static shaft 84 extends through the rear journal bearing 82.

A pair of rear static struts 16 is fixed or coupled at upper strut portions 90 to the hull 72 or other suitable support coupled to the hull 72 or superstructure 70. The lower strut portions 92 are fixed to the rear end portion 88 of the static shaft 84. In this manner, the static shaft 84 is fixed in position with respect to the hull 72, if attached directly to the hull. If attached to an outrigger beam or other support structure coupled to the hull 72 or superstructure 72, the static shaft 84 can be maintained in a permanent fixed position or lowered and raised into and out of a body of water with a powered linkage as discussed above.

In order to roll the hydroski 10 around the static shaft 84, a pair of rigid links or flexible cables 96 is coupled at their lower ends to the hydroski 10 with a pair of pivot links 98. Pivot links 98 are secured to the upper surface 100 of the hydroski 10 using conventional fastening techniques. The upper ends of the links or cables 96 are pivotally connected to a crank arm 102. The crank arm 102 is fixed to a drive shaft 104.

The drive shaft 104 can be selectively driven in clockwise and counterclockwise directions with any suitable driver 106 such as a reversible electric motor, a reversible gear train connected to a combustion engine, a reversible fluid motor, or reciprocating fluid cylinders and the like.

The driver 106 can be controlled and coordinated by any suitable controller 108 programmed to effect the coordinated rolling movements such as those identified in Table 1 and as depicted in FIGS. 16, 17, 21, 22, 26 and 27, as well as other possible hydroski arrangements. It can be appreciated that as crank arm 102 is driven in the manner of a bellcrank, the links or cables 96 transfer this rocking motion to the hydroski 10 which rocks or rolls laterally back and forth around the static shaft 84 in coordinated movement with the crank arm 102, drive shaft 104 and driver 106. In this manner a watercraft 50 can be effectively steered over a body of water using only a plurality of low-draft hydroskis 10.

It will be appreciated by those skilled in the art that the above water steering craft systems are merely representative of the many possible embodiments of the disclosure and that the scope of the disclosure should not be limited thereto, but instead should only be limited according to the following claims.

What is claimed:

1. A watercraft, comprising:

a hull configured to move over a body of water, said hull having a front portion, a central portion, a rear portion, a port portion and a starboard portion;

a plurality of hydroskis coupled to said hull, each of said plurality of hydroskis having a lateral port side portion, a lateral starboard side portion, a bow portion, a stern portion and a bottom surface portion between said lateral port and starboard side portions;

at least one of said plurality of hydroskis being selectively controlled to roll said port and starboard side edge portions back and forth about a local longitudinal axis such that each one of said lateral port and starboard side portions selectively moves deeper into the body of water than the other one of said lateral port and starboard side portions so as to generate a resultant side force against said bottom surface portion and to provide a turning force to effect navigable control of said watercraft; and wherein said bow portion of said at least one hydroski is above the body of water when on plane and only said stern portion is on the body water.

2. The watercraft of claim 1, further comprising a powered driver coupled to said at least one hydroski and controlling movement of said at least one hydroski such that said at least one hydroski defines a roll angle between said bottom surface portion and said body of water as said watercraft is turned and such that said side force is proportional to the sine of said roll angle.

3. The watercraft of claim 1, wherein said hull is positioned below a waterline when at rest and wherein each of said plurality of hydroskis extends upwardly from the waterline and supports said hull above said waterline as said watercraft reaches a planing speed.

4. The watercraft of claim 1, wherein said at least one hydroski extends upwardly with respect to said waterline at an angle of about 5° to 15° .

5. The watercraft of claim 1, wherein a first one of said plurality of hydroskis is disposed adjacent said front portion of said hull, a second one of said plurality of hydroskis is disposed adjacent said port portion of said hull and a third one of said hydroskis is positioned adjacent said starboard portion of said hull.

6. The watercraft of claim 1, wherein a central pair of said plurality of hydroskis is disposed adjacent said central portion of said hull.

7. The watercraft of claim 1, wherein a stern pair of said hydroskis is disposed adjacent said rear portion of said hull.

8. The watercraft of claim 1, wherein one of said plurality of hydroskis is disposed adjacent said rear portion of said hull.

9. The watercraft of claim 1, further comprising a source of thrust supported by said hull and disposed above the body of water.

10. The watercraft of claim 1, further comprising a source of thrust extending below the body of water to a first depth when said watercraft is at rest and extending below the body of water to a second depth less than said first depth when said watercraft is in motion.

11. The watercraft of claim 2, wherein said powered driver comprises at least one of an electric actuator, a hydraulic actuator and a gas actuator.

12. The watercraft of claim 1, further comprising a steering system selectively rolling said at least one of said plurality of hydroskis.

13. The watercraft of claim 1, further comprising a steering system providing steering forces to said hull exclusively with at least one of said plurality of hydroskis.

14. The watercraft of claim 1, wherein said plurality of hydroskis comprises at least three skis.

15. The watercraft of claim 1, further comprising a source of fixed thrust providing thrust in a single direction.

16. The watercraft of claim 1, wherein at least one of said plurality of hydroskis is retractable above the waterline.

17. A method of steering a watercraft having a hull configured to move over a body of water, a longitudinal axis, a center of gravity and a plurality of skis coupled to said hull, each of said plurality of skis comprising a lateral port side portion, a lateral starboard side portion, a bow portion, a stern portion and a bottom surface portion between said lateral port and starboard side portions, and wherein said method comprises:

rolling at least one of said plurality of skis in clockwise and counterclockwise directions adjacent said hull and about a local longitudinal axis extending substantionally longitudinally along said hull; and wherein said method further comprises steering said watercraft exclusively with said stern portion of one or more of said plurality of skis such that only said stern portion of said one or more of said plurality of skis is on the body of water and said bow portion of said one or more skis is above the body of water.

18. The method of claim 17, further comprising rolling a first one of said skis on one side of said hull and rolling a second one of said skis on another side of said hull.

19. The method of claim 18, wherein said first and second skis are rolled in the same clockwise direction.

20. The method of claim 19, wherein said first and second skis are respectively rolled in opposite clockwise directions.

21. The method of claim 20, wherein said first ski is located fore of said center of gravity and said second ski is located aft of said center of gravity.

* * * * *